US006066005A

United States Patent [19]

Belopolsky

[11] Patent Number: 6,066,005

[45] Date of Patent: May 23, 2000

[54] VERTICAL MODULAR CONNECTOR HAVING LOW ELECTRICAL CROSSTALK

[75] Inventor: Yakov Belopolsky, Harrisburg, Pa.

[73] Assignee: Berg Technology, Inc., Reno, Nev.

[21] Appl. No.: 09/109,246

[22] Filed: Jun. 30, 1998

[51] Int. Cl.[7] ..... H01R 23/02

[52] U.S. Cl. ..... 439/676

[58] Field of Search ..... 439/676

[56] References Cited

U.S. PATENT DOCUMENTS

| | | | |
|---|---|---|---|
| 3,761,842 | 9/1973 | Bentley | 333/1 |
| 5,186,647 | 2/1993 | Denkmann et al. | 439/395 |
| 5,299,956 | 4/1994 | Brownell et al. | 439/638 |
| 5,310,363 | 5/1994 | Brownell et al. | 439/676 |
| 5,362,257 | 11/1994 | Neal et al. | 439/676 |
| 5,403,200 | 4/1995 | Chen | 439/404 |
| 5,626,497 | 5/1997 | Bouchan et al. | 439/676 |
| 5,674,093 | 10/1997 | Vaden | 439/676 |
| 5,759,070 | 6/1998 | Belopolsky | 439/676 |
| 5,779,503 | 7/1998 | Tremblay et al. | 439/676 |

*Primary Examiner*—Paula Bradley
*Assistant Examiner*—Antoine Ngandjui
*Attorney, Agent, or Firm*—Daniel J. Long; Brian J. Hamilla; M. Richard Page

[57] ABSTRACT

A modular jack assembly which has a base wall. A first lateral wall having a terminal end and an interior face and an exterior face extends longitudinally from the base. A second lateral wall extends axially from the base in spaced opposed relation to the first lateral wall. A third lateral wall and a fourth lateral wall are interposed in spaced relation between the first lateral wall and second lateral wall and extends axially from the base to form an insert receiving cavity. A plurality of laterally spaced conductors is arranged in a first group and a second group. The first group of conductors extends from the base to adjacent the terminal end of the first lateral wall and press through the lateral wall in a first plane. A second group of conductors extends longitudinally from the base to adjacent the terminal end of the first lateral wall in a and passes through that wall in the second plane which is at a different height from the first plane.

20 Claims, 3 Drawing Sheets

VERTICAL MODULAR CONNECTOR HAVING LOW ELECTRICAL CROSSTALK

BACKGROUND OF THE INVENTION

1. Field of the Invention

The present invention relates to electrical connectors and more particularly to modular jacks for use in telecommunications equipment.

2. Brief Description of Prior Developments

Modular jacks are used in two broad categories of signal transmission: analog (voice) and digital (data) transmission. These categories can overlap somewhat since digital systems are used for voice transmission as well. Nevertheless, there is a significant difference in the amount of data transmitted by a system per second. A low speed system would ordinarily transmit from about 10 to 16 megabytes per second (Mbps), while a high speed system should be able to handle 155 Mbps or even higher data transfer speeds. Often, high speed installations are based on asynchronous transfer mode transmission and utilize shielded and unshielded twisted pair cables.

With recent increases in the speed of data transmission, requirements have become important for electrical connectors, in particular, with regard to the reduction or elimination of crosstalk. Crosstalk is a phenomena in which a part of the electromagnetic energy transmitted through one of multiple conductors in a connector causes electrical currents in the other conductors.

Another factor which must be considered is that the telecommunications industry has reached a high degree of standardization in modular jack design. Outlines and contact areas are essentially fixed and have to be interchangeable with other designs. It is, therefore, important that any novel modular jack allow with only minor modification, the use of conventional parts or tooling in its production.

There is, therefore, a need for a modular jack and a modular jack insert which will reduce or eliminate crosstalk in telecommunications equipment.

There is also a need for such a modular jack and modular jack insert which can reduce or eliminate crosstalk and common mode interference which is interchangeable with prior art modular jacks and which may be manufactured using conventional parts and tooling.

SUMMARY OF THE INVENTION

The present invention is a modular jack assembly which has a base wall. A first lateral wall having a terminal end and an interior face and an exterior face extends longitudinally from the base. A second lateral wall extends axially from the base in spaced opposed relation to the first lateral wall. A third lateral wall and a fourth lateral wall are interposed in spaced relation between the first lateral wall and second lateral wall and extends axially from the base to form an insert receiving cavity. A plurality of laterally spaced conductors is arranged in a first group and a second group. The first group of conductors extends from the base to adjacent the terminal end of the first lateral wall and press through the lateral wall in a first plane. A second group of conductors extends longitudinally from the base to adjacent the terminal end of the first lateral wall in a and passes through that wall in the second plane which is at a different height from the first plane.

The present invention also encompasses a modular jack insert which has an insulative body having a base, a terminal end and opposed lateral faces which extend longitudinally from the base. A first group of conductors extends from the base to adjacent the terminal end of the insulative body adjacent the first lateral wall in the first plane. A second group of conductors extends longitudinally from the base to the terminal end of the insulative body and passes though that wall in a first plane. A second group of conductors extends from the face to adjacent the terminal end of the insulative body and passes through the insulative body in a second plane which is at a different height from the first plane.

BRIEF DESCRIPTION OF THE DRAWINGS

The present invention is further described with reference to the accompanying drawings in which.

DETAILED DESCRIPTION OF THE PREFERRED EMBODIMENTS

Figure 1:
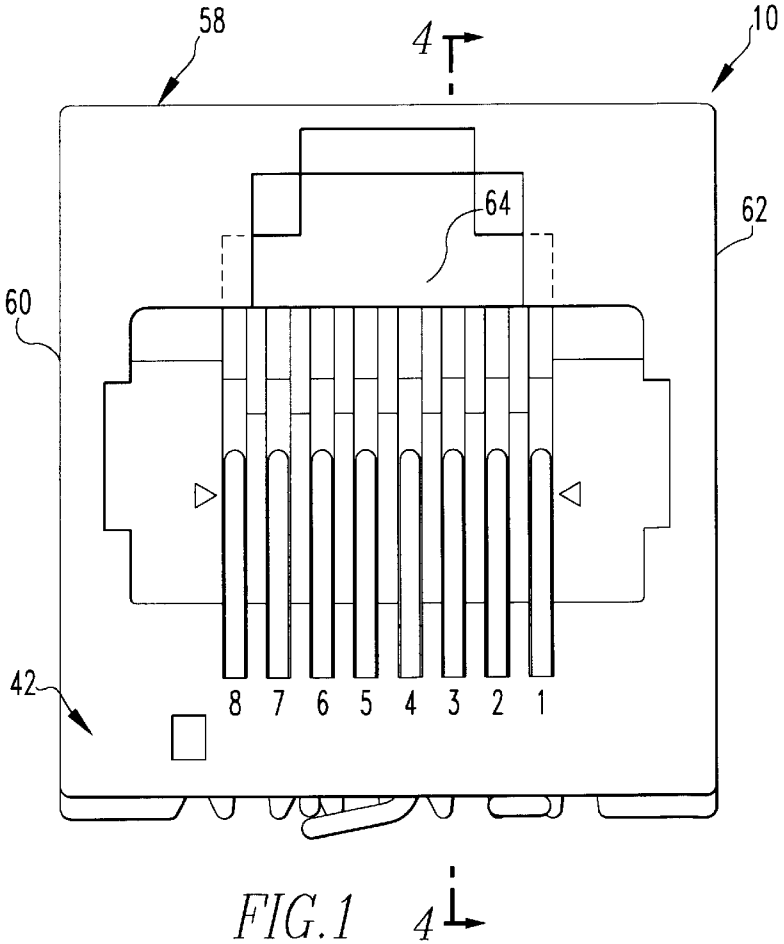
FIG. 1 is a top plan view of a modular jack comprising a preferred embodiment of the present invention.
Figure 2:
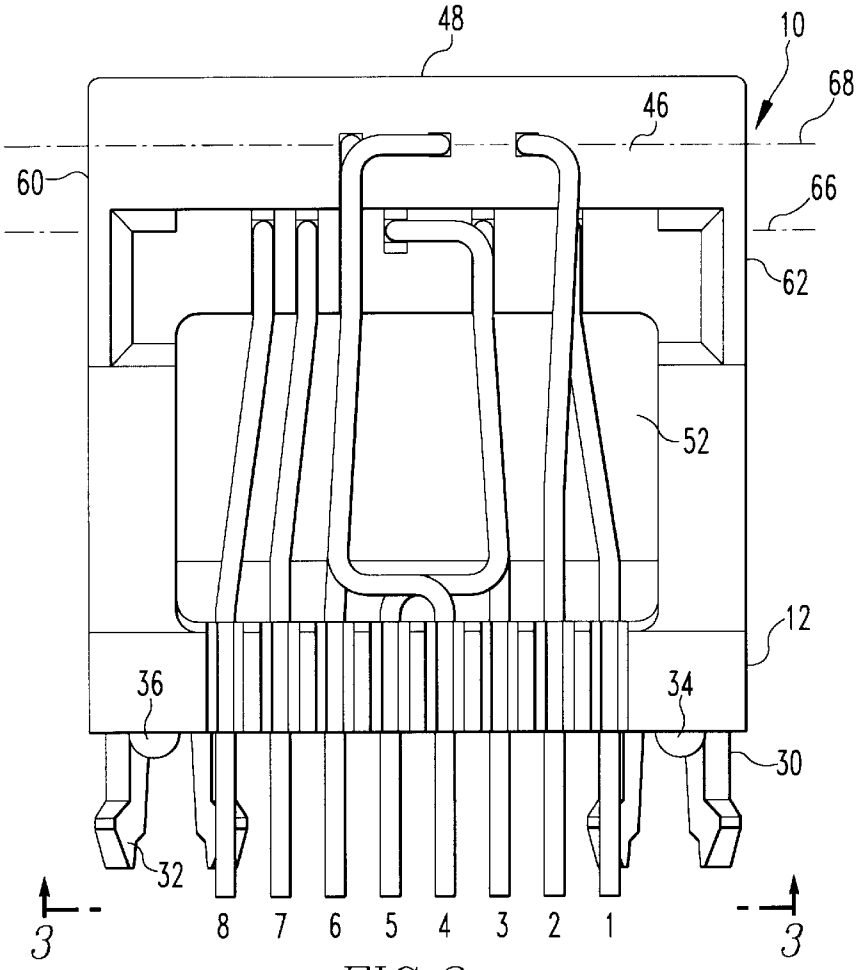
FIG. 2 is a rear elevational view of the modular jack shown in FIG. 1.
Figure 3:
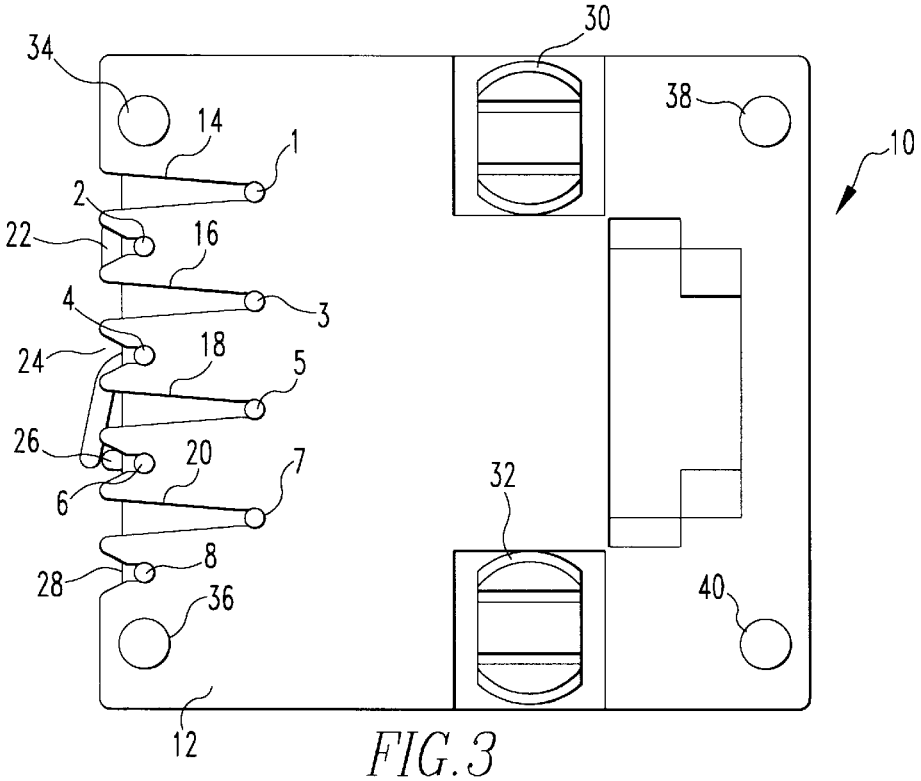
FIG. 3 is a bottom plan view of the modular jack shown in FIG. 1.
Figure 4:
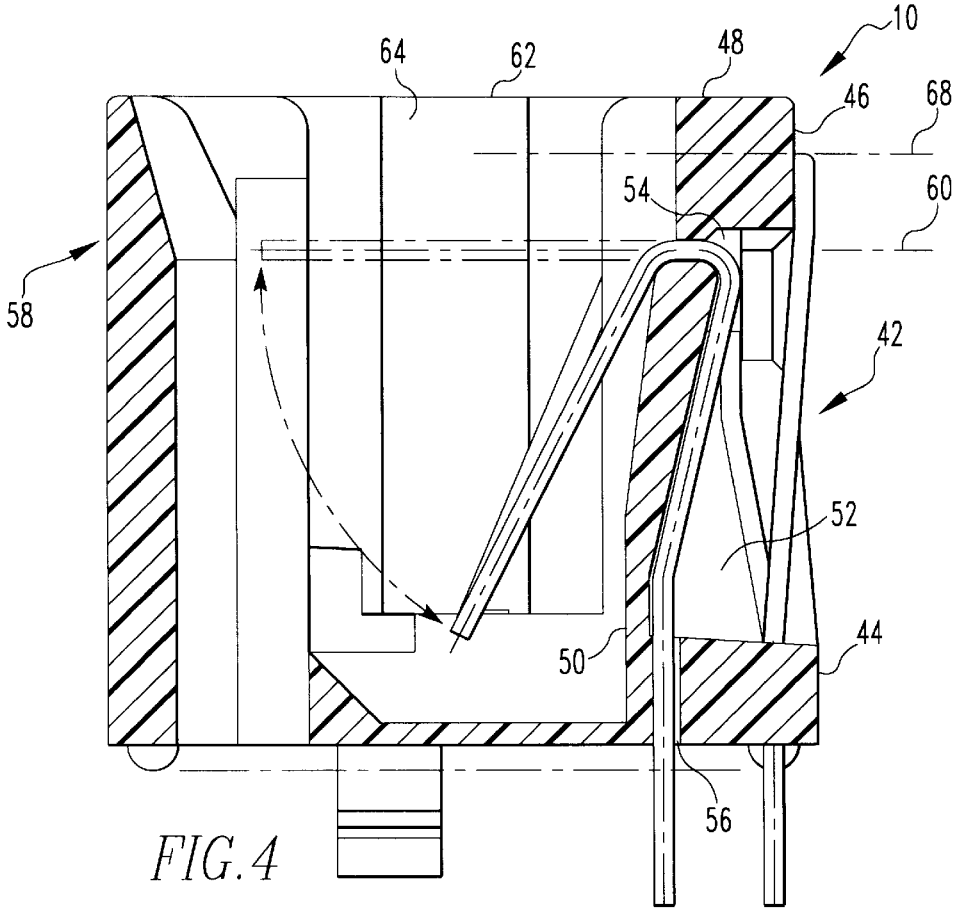
FIG. 4 is a bottom plan view of the modular jack shown in FIG. 1.

In the modular jack assembly of this invention the lateral walls preferably extend vertically from the base, and the conductors are wires. The second plane also is preferably positioned in spaced outward relation from the first plane. The conductors are contacts 1, 2, 3, 4, 5, 6, 7 and 8 arranged in sequential order, and contacts 1, 3, 5, 7 and 8 are preferably in the first plane and contacts 2, 4 and 6 are preferably in the second plane.

The conductors preferably have a lower larger pitch and an upper smaller pitch, and the larger pitch is 0.050" and the smaller pitch is 0.040". Preferably contact 4 is also bent to extend first laterally then longitudinally to be in coplanar relation with contact 6. Contact 4 is preferably bent at an angle of about 90°, and contact 5 is preferably bent first laterally then longitudinally to be in coplanar relation with contact 3 while contact 4 is bent at an angle of about 90°. Other preferred arrangements will be apparent from the following description.

Referring to FIGS. 1–4, the modular jack assembly includes an insulative housing shown generally at numeral 10. This housing includes a base wall 12 which has a plurality of deep V-shaped grooves 14, 16, 18 and 20. Adjacent to each of these deep V-shaped grooves there is a shallow V-shaped groove 22, 24, 26 and 28. On the base wall there are two surface mounting pins 30 and 32 as well as location features 34, 36, 38 and 40. Extending vertically from the horizontal base wall there is a first lateral wall 42 which has a base 44, a top structure 46 and an upper terminal edge 48. This first lateral wall also has an interior face 50 and an opposed exterior face with a recess 52. There are a plurality of apertures as at aperture 54 through which contacts pass through this interior wall. Similarly there are apertures as at aperture 56 (FIG. 4) through which contacts pass through the base wall 12. The jack also includes a second lateral wall 58 which extends vertically from the base wall 12 in opposed spaced relation to the first lateral 42. A spaced parallel third lateral wall 60 and fourth lateral wall 62 perpendicularly connect the first lateral wall 42 and the second lateral wall 58 to form a conventional insert receiving cavity 64. There are also 8 conductive contacts 1, 2, 3, 4, 5, 6, 7 and 8. Contacts 1, 3, 5, 7 and 8 pass through lateral wall 48 in a first lower plane 66. Contacts 2, 4 and 6 pass through lateral wall 48 in a second higher plane 68 which is inwardly spaced in parallel elevation from the first outer plane. Each of these contacts has a top contact pitch of 0.040" and a bottom contact pitch of 0.050". Contact 2 is curved to be superimposed over contact 1 in the area of the 0.040" contact pitch. Contact 4 is bent laterally and then longitudinally to be superimposed over and coplanar with contact 6 over the longest possible distance. Contact 5 is bent to extend laterally and then longitudinally to be superimposed over and coplanar with contact 3 over the longest possible distance. The bending angles of these contacts are approximately 90°.

Figure 6:
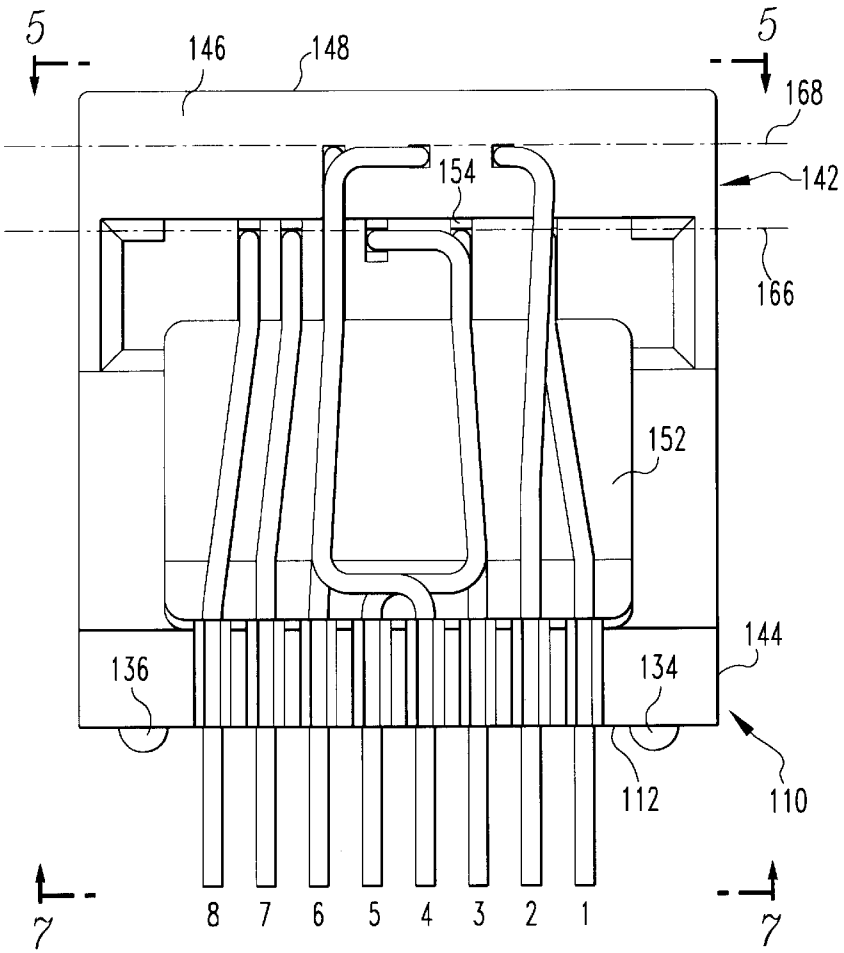
FIG. 6 is a rear elevational view of the insert shown in FIG. 5.
Figure 5:
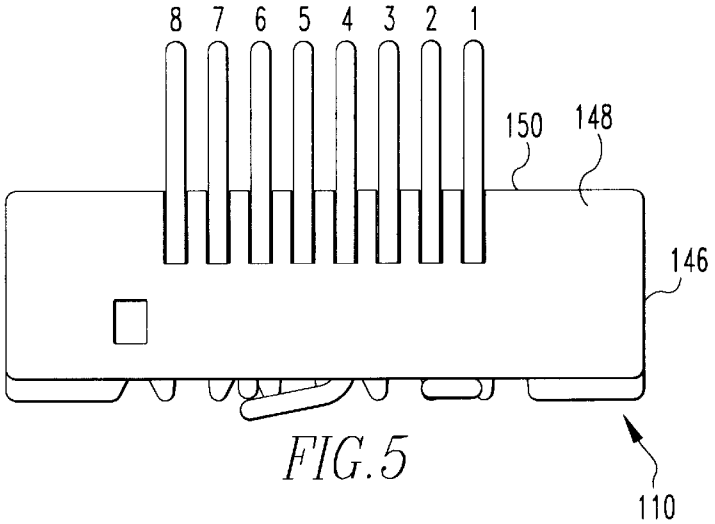
FIG. 5 is a top plan view of an insert representing an alternate preferred embodiment of the present invention.
Figure 7:
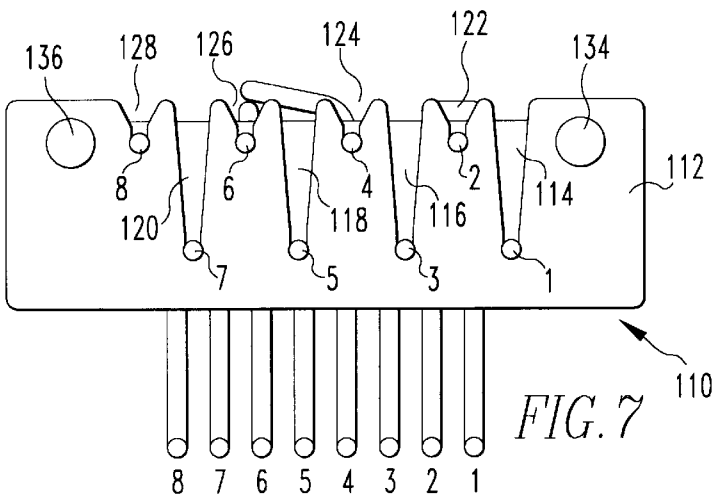
FIG. 7 is a bottom plan view of the insert shown in FIG. 5.

Referring to FIGS. 5–7, the modular jack insert which represents an alternate embodiment of this invention includes an insulative housing shown generally at numeral 110. This insert includes a base wall 112 which has a plurality of deep V-shaped grooves 114, 116, 118 and 120. Adjacent to each of these deep V-shaped grooves there is a shallow V-shaped groove 122, 124, 126 and 128. On the base wall there are two location features 134 and 136. Extending vertically there is a body 142 which has a base 144, a top structure 146 and an upper terminal edge 148. This first body 142 also has an interior face 150 and an opposed exterior face and recess 152. There are a plurality of apertures as at aperture 154 through which contacts pass through this interior wall. Similarly there are apertures (not shown) through which contacts pass through the base wall 112. There are also 8 conductive contacts 1, 2, 3, 4, 5, 6, 7 and 8. Contacts 1, 3, 5, 7 and 8 pass through the body 142 in a first lower plane 166. Contacts 2, 4 and 6 pass through body 142 in a second higher plane 168 which is inwardly spaced in parallel elevation from the first outer plane. Each of these contacts has a top contact pitch of 0.040" and a bottom contact pitch of 0.050". Contact 2 is curved to be superimposed over contact 1 in the area of the 0.040" contact pitch. Contact 4 is bent laterally and then longitudinally to be superimposed over and coplanar with contact 6 over the longest possible distance. Contact 5 is bent to extend laterally and then longitudinally to be superimposed over and coplanar with contact 3 over the longest possible distance. The bending angles of these contacts are approximately 90°. As will be appreciated by those skilled in the art, the above described insert may be inserted in an insulated housing (not shown) to form a completed jack.

EXAMPLE

A number of jacks were manufactured according to the above specification. Crosstalk was measured using these jacks at 100 MHz. The results of this test is shown in Table I.

TABLE I

| | | Near End Crosstalk Loss @ 100 MHz, −dB | | | | | |
|---|---|---|---|---|---|---|---|
| Sample No | PLUG | ½–⅙ Green-OR | ½–⅘ Green-BL | ½–⅞ Green-BR | ⅙–⅘ Orange-BL | ⅙–⅞ Orange-BR | ⅘–⅞ Blue-BR |
| | | JACK TEST DATA WITH CERTIFIED PLUGS | | | | | |
| SPEC | | 40 | 40 | 40 | 40 | 40 | 40 |
| 30.3 | 15 | 46.1 | 44.6 | 74.9 | 49.2 | 46.3 | 47.3 |
| 30.3 | 16 | 48.3 | 44.1 | 65.7 | 48.7 | 45.9 | 44.4 |
| 30.3 | 14 | 47.9 | 46.2 | 71.3 | 48.8 | 48.3 | 47.2 |
| | | PLUG CERTIFICATION TEST DATA per TSB 40 A | | | | | |
| SPEC | PLUG | >45 | >55 | >55 | >40 | >45 | >55 |
| | 15 | 46.7 | 76.3 | 64.3 | 42.7 | 47.2 | 79.1 |
| | 16 | 49.5 | 66.5 | 59.9 | 40.7 | 47.5 | 73.6 |
| | 14 | 46.4 | 70.6 | 63.0 | 41.1 | 47.6 | 64.7 |

It will be appreciated that a modular jack assembly has been described which provides surprisingly and unexpectedly low near end to crosstalk.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly comprising:

(a) a base;

(b) a first lateral wall having a terminal end and an interior face and an exterior face and extending longitudinally from the base;

(c) a second lateral wall extending axially from the base in spaced opposed relation to the first lateral wall;

(d) a third lateral wall and a fourth lateral wall interposed in spaced relation between the first lateral wall and second lateral wall and extending axially from the base to form an insert receiving cavity;

(e) a plurality of laterally spaced conductive means arranged in a first group and a second group and said first group of conductive means extends from the base to adjacent terminal end of the first lateral wall and passes through the first lateral wall in a first plane, and a second group of conductive means extending longitudinally from the base to adjacent the terminal end of the first lateral wall and passes through the first lateral wall in a second plane longitudinally spaced from said first plane, wherein the second plane is positioned in spaced outward relation from the first plane; the conductive means are contacts 1,2,3,4,5,6,7 and 8, and said contacts 1,2,3,4,5,6, 7 and 8 are arranged laterally in sequential numerical order and contacts 1,3,5,7 and 8 are in the first plane and contacts 2, 4 and 6 are in the second plane; and contact 2 is curved to be located over contact 1.

2. The modular jack assembly of claim 1 wherein the lateral walls extend vertically.

3. The modular jack assembly of claim 1 wherein the conductive means are wires.

4. The modular jack of claim 1 wherein contact 5 is bent first laterally then longitudinally to be in coplanar relation with contact 3.

5. The modular jack assembly of claim 1 wherein the conductive means have a lower larger pitch area and an upper smaller pitch area.

6. The modular jack assembly of claim 5 wherein the larger pitch is 0.050" and the smaller pitch is 0.040".

7. The modular jack assembly of claim 5 wherein contact 2 is curved to be located over contact 1 in the upper smaller pitch area.

8. The modular jack of claim 1 wherein contact 4 is bent to extend first laterally then longitudinally to be in coplanar relation with contact 6.

9. The modular jack of claim 8 wherein contact 4 is bent at an angle of about 90°.

10. The modular jack of claim 9 wherein contact 4 is bent at an angle of about 90°.

11. A modular jack insert comprising:

(a) an insulative body having a base, a terminal end and opposed first and second lateral sides extending longitudinally from the base; and (b) a plurality of laterally spaced conductive means arranged in a first group and a second group and said first group of conductive means extending from the base to adjacent terminal end of the insulative body and passes through the insulative body in a first plane, and a second group of conductive means extending longitudinally from the base to adjacent terminal end of the insulative body and passes through the insulative body in a second plane longitudinally spaced from said first plane, wherein the second plane is positioned in spaced outward relation from the first plane; the conductive means are contacts 1,2,3,4,5,6,7 and 8 and said contacts 1,2,3,4,5,6,7 and 8 are arranged laterally in sequential numerical order and contacts 1,3,5,7 and 8 are in the first plane and contacts 2,4 and 6 are in the second plane; and contact 2 is curved to be located over contact 1.

12. The modular jack insert of claim 11 wherein the lateral wall extends vertically from its base.

13. The modular jack insert of claim 11 wherein the conductive means are wires.

14. The modular jack insert of claim 11 wherein contact 2 is curved to be located over contact 1 in the upper smaller pitch area.

15. The modular jack insert of claim 11 wherein contact 5 is bent first laterally then longitudinally to be in coplanar relation with contact 3.

16. The modular jack insert of claim 11 wherein the conductive means have a lower larger pitch area and an upper smaller pitch area.

17. The modular jack insert of claim 16 wherein the larger pitch is 0.050" and the smaller pitch is 0.040".

18. The modular jack insert of claim 11 wherein contact 4 is bent to extend first laterally then longitudinally to be in coplanar relation with contact 6.

19. The modular jack insert of claim 18 wherein contact 4 is bent at an angle of about 90°.

20. The modular jack insert of claim 19 wherein contact 4 is bent at an angle of about 90°.

* * * * *